United States Patent [19]

Barnett

[11] Patent Number: 4,587,944

[45] Date of Patent: May 13, 1986

[54] CROSSBOW STOCK

[75] Inventor: Bernard T. Barnett, Ryton, Nr. Shifnal, England

[73] Assignee: B & P Barnett Limited, West Midlands, England

[21] Appl. No.: 526,492

[22] Filed: Aug. 19, 1983

[30] Foreign Application Priority Data

Dec. 17, 1982 [GB] United Kingdom ..... 8235975

[51] Int. Cl.[4] ..... F41B 5/00

[52] U.S. Cl. ..... 124/25

[58] Field of Search ..... 124/25, 80, 86, 88, 124/1; 182/214; 403/90, 93, 95, 96, 111, 145

[56] References Cited

U.S. PATENT DOCUMENTS

| | | | |
|---|---|---|---|
| 2,842,114 | 7/1958 | Duncan | 124/25 |
| 2,954,247 | 9/1960 | Hibaen | 403/93 |
| 3,224,427 | 12/1965 | Ronan | 124/25 |

*Primary Examiner*—Richard J. Apley
*Assistant Examiner*—William R. Browne
*Attorney, Agent, or Firm*—Berman, Aisenberg & Platt

[57] ABSTRACT

A crossbow stock has a stirrup pivotally mounted on the fore-end portion of the stock to pivot between a first position in which the stirrup extends longitudinally of the stock beyond the fore-end thereof and a second position in which the entire stirrup lies adjacent to the stock. In its first position, the stirrup can be used for holding the stock during cocking on the bow.

2 Claims, 4 Drawing Figures

CROSSBOW STOCK

BACKGROUND OF THE INVENTION

This invention relates to a crossbow stock. The stock of a crossbow includes a fore-end portion which, when the stock is in use, supports a bow prod so that the prod extends transversely of the length of the stock and a bow string extends across the stock between opposite ends of the prod.

There have been used for some years crossbow stocks having stirrups mounted on the fore-end portions, in each case the stirrup being rigid with the remainder of the stock and projecting therefrom in a direction longitudinally of the stock. These stirrups facilitate cocking of the bows, the user inserting a foot into the stirrup to hold the stirrup on the ground during cocking.

Although the provision of a stirrup on the fore-end portion of a crossbow makes cocking of the bow much easier that it would be without the assistance of the stirrup, stirrups are not used universaly on crossbows because they have attendant disadvantages. One of these is that the overall length of the crossbow is increased considerably by the provision of a stirrup. Crossbows are cumbersome objects, whether they include stirrups or not, and the known stirrups are a considerable inconvenience during transport and storage of a crossbow. When a crossbow is used for certain purposes, for example shooting non-captive animals, it is desirable that the bolt which is fired from the crossbow should be connected with the crossbow by a long length of light line, in order that the animal can be found, if it should become concealed from view, after being shot. When a line is used, this is stored on a reel mounted on the fore-end portion of the crossbow stock adjacent to the fore-end thereof. However, a reel of line cannot be used satisfactorily with the known crossbows having stirrups on the fore-end portions.

SUMMARY OF THE INVENTION

According to the present invention, there is provided a crossbow stock having a stirrup mounted on the fore-end portion of the stock for pivoting relative thereto about a stirrup axis between a first position in which the stirrup extends from the stirrup axis in a direction longitudinally of the stock beyond a fore-end of the stock and a second position in which a part of the stirrup remote from the stirrup axis lies adjacent to the stock, and means for releasably opposing pivoting of the stirrup relative to the stock from one of said positions when the stirrup has been set in said one of the positions.

The stirrup of a crossbow stock in accordance with the invention can be set in a position in which it does not contribute significantly to the overall length of the bow and in which it does not intrude on the space immediately adjacent to the fore-end of the stock. A further advantage of a crossbow stock in accordance with the invention is that, when in its second position, the stirrup can conveniently be used as a finger-grip and thus enable the user to hold the crossbow more easily, in particular, to control the bow more easily during firing.

The stock preferably includes a releasable clamping mechanism for clamping a bow prod to the fore-end portion of the stock in the position of use and, in these cases, the stirrup preferably constitutes a handle of the clamping mechanism.

BRIEF DESCRIPTION OF THE DRAWINGS

Two examples of crossbows embodying the invention will now be described, with reference to the accompanying drawing, wherein.

DETAILED DESCRIPTION

Figure 1:
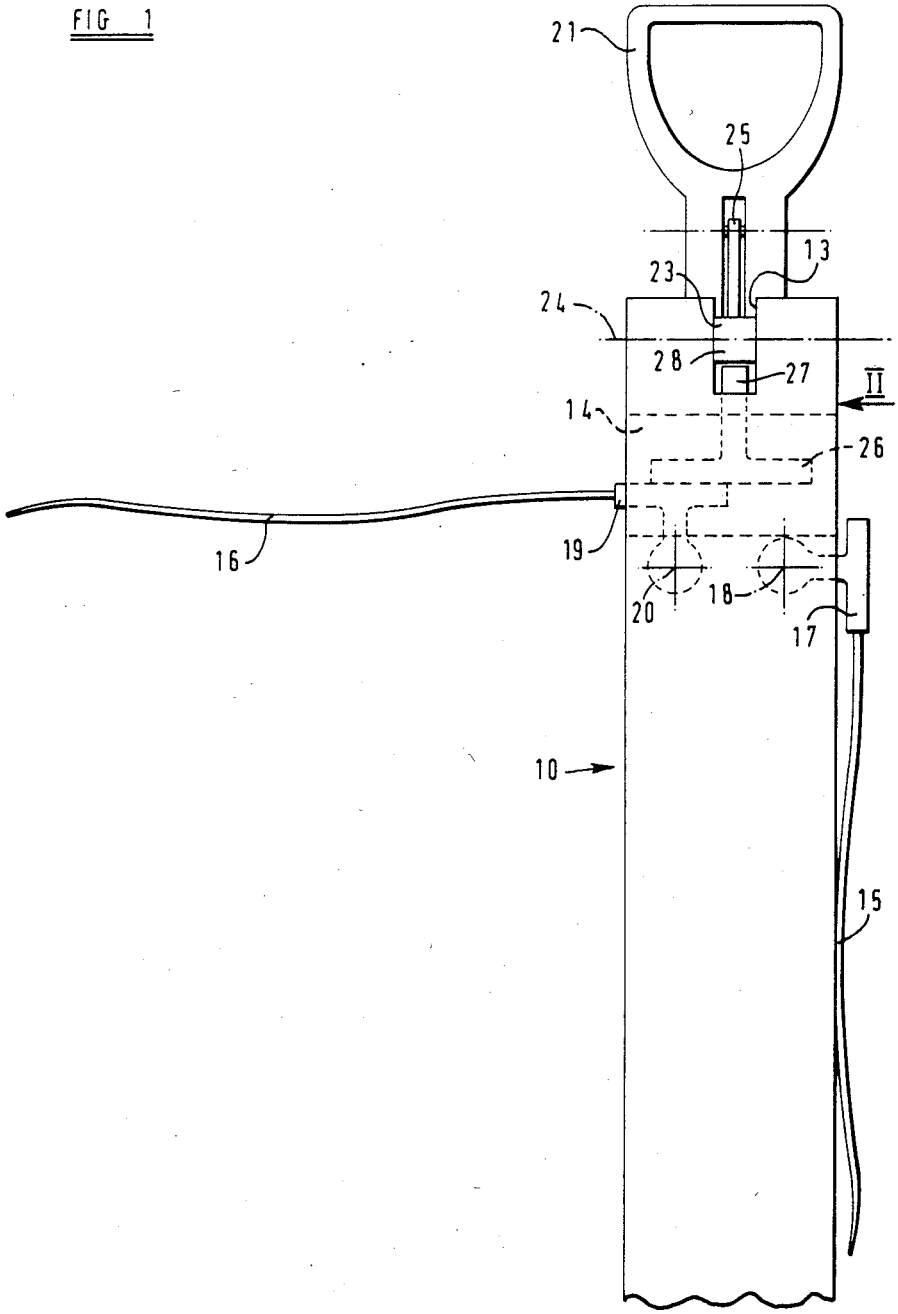
FIG. 1 shows an underneath plan view of a part of the crossbow including a fore-end portion of the stock and the bow prod.
Figure 2:
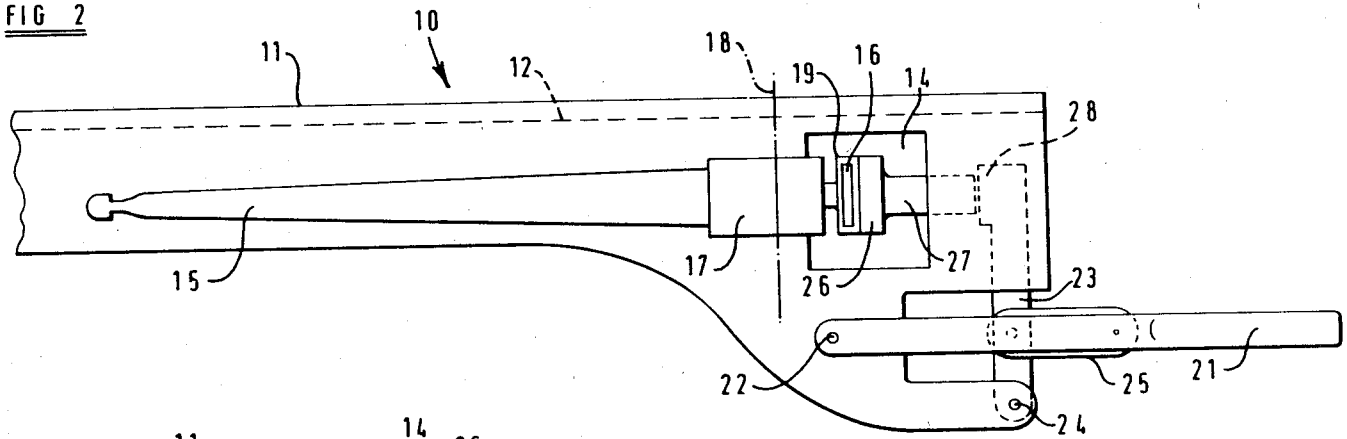
FIG. 2 shows a side elevation on the arrow 11 of FIG. 1.
Figure 3:
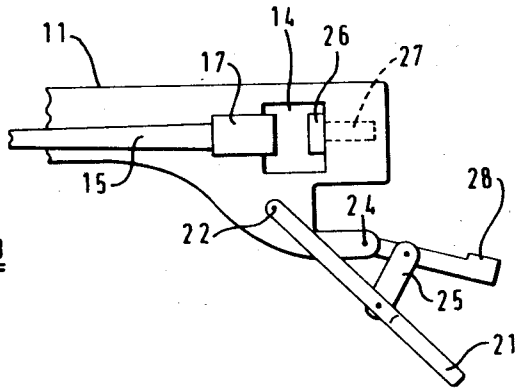
FIG. 3 shows on a reduced scale a side elevation similar to FIG. 2 but showing a clamping mechanism of the crossbow in released position.

The crossbow shown in FIGS. 1 to 3 comprise an elongated stock, only a fore-end portion 10 of which is illustrated in the drawing. The remainder of the stock may be of known form and include a butt. The remainder of the stock carries a trigger mechanism (not shown) arranged in a known manner. An upper surface 11 of the stock constitutes a guide surface for guiding a bolt (not shown) when the bolt is fired from the crossbow in a known manner. In the guide surface, there is provided a rectilinear groove 12 in which the bolt can slide. Adjacent to its free end, there is a formed in the fore-end portion 10 a slot 13 which extends downwardly from the groove 12 to the underside of the stock. A laterally extending aperture 14 is formed in the fore-end portion at a position spaced somewhat towards the butt from the slot 13, this aperture opening at opposite side faces of the stock but being closed from the guide surface 11 and from the underside of the stock.

On the fore-end portion 10 there is supported a bow prod formed in two identical parts 15 and 16. One end portion of the prod part 15 is engaged in a shoe 17 mounted in the fore-end 10 for pivoting about an axis 18 which is perpendicular to the guide surface 11. An end portion of the prod part 16 is received in a similar shoe 19 mounted for pivoting relative to the stock about an axis 20. The axes 18 and 20 are parallel to each other, spaced apart laterally of the stock to lie on opposite sides of the groove 12 and are spaced from the aperture 14 somewhat in a direction away from the free end of the fore-end portion 10.

It will be seen that the prod parts 15 and 16 can swing independently of each other relative to the stock between a first position occupied by the part 15 in FIG. 1, in which the shoe 17 lies outside the aperture 14 and the prod part 15 is approximately parallel to the length of the stock, so that the prod part contacts the stock at a position remote from the shoe 17, and a second position occupied by the prod part 16 in FIG. 1, in which the prod part extends approximately at right angles to the length of the stock and the shoe 19 lies partly within the aperture 14.

It will be understood that, when the bow is in use, both of the prod parts 15 and 16 would occupy their second positions. In this configuration, the crossbow is somewhat cumbersome. For transport and storage of the crossbow between periods of use, the two prod parts would be moved to their first positions to provide a relatively compact configuration of the crossbow.

Each prod part 15, 16 may be releasably mounted in its shoe 17, 19. Alternatively, the prod parts may be permanently secured in their shoes, the shoes being removed from the fore-end portion 10 if it is required to substitute a new prod for the prod originally mounted on the fore-end portion.

For establishing and maintaining the second positions of the prod parts, there is provided a clamping mechanism which is mounted on the fore-end portion 10 of the stock. The clamping mechanism comprises a handle 21 which, in the particular example illustrated, has the form of stirrup. This handle is mounted for pivoting relative to the fore-end portion about an axis 22 which, when the crossbow is in use, lies below the aperture 14 and is generally horizontal. The mechanism further comprises a lever 23 mounted for pivoting on the fore-end portion 10 about an axis 24 parallel to the axis 22, spaced somewhat further from the guide surface 11 than is the axis 22 and spaced somewhat further from the butt of the crossbow than is the axis 22. For transmitting force between the handle 21 and the lever 23, there is provided a strut 25 pivoted adjacent to one of its ends on the handle 21 at a position between the axis 22 and a free end of the handle and the strut being pivoted adjacent to its other end on the lever 23 at a position between the axis 24 and a free end of the lever.

The clamping mechanism further comprises a pressure plate 26 disposed within the aperture 14 and guided for rectilinear movement relative to the fore-end portion 10 along the length of the stock. A guide pin 27 extends from the pressure plate 26 into the slot 13. On the end portion of the lever 23 remote from the axis 24, there is provided an adjustable abutment 28 which, by pivoting of the handle 21, can be moved into the slot 13 and engaged with the guide pin 27 to urge the pressure plate in a direction away from the free end of the fore-end portion 10. It will be seen that the clamping mechanism provides a considerable mechanical advantage to a user who grasps an end portion of the handle 21 remote the axis 22, so that a user can apply a relatively large force to the pressure plate.

When the handle 21 is pivoted to the position illustrated in FIG. 3, the abutment 28 is withdrawn from the slot 13 and the pressure plate 26 can move within the aperture 14 away from the shoes 17 and 19. The prod parts 15 and 16 can then be swung from their second positions to their first positions.

Even if a bow string (not shown) is connected between the free ends of the prod parts 15 and 16, these can easily be moved by application of force to the prod parts directly by the hands of a user through a major part of their travel from the first position to the second position. In this way, the shoes 17 and 19 can be reintroduced into the aperture 14 to lie just to the rear of the pressure plate 26. If the handle 21 is then pivoted by the user towards the position illustrated in FIG. 2, the abutment 28 is driven along the slot 13 to force the pressure plate 26 against shoes 17 and 19 so that pivoting of the shoes is continued until the prod parts occupy their second position.

As the prod parts 15 and 16 move into their second positions, the strut 25 moves into or through a central position by which we mean a position in which the axis of the pivotal connection between the strut and the lever 23 lies in a plane containing the axis 22 and the axis of the pivotal connection between the strut and the handle 21. An abutment may be provided on one of the handle 21 and lever 23 to engage the strut and limit movement of the strut when this central position has been reached or has just been passed. It will be seen that, when the lever 23 is in the position shown in FIG. 2, any force exerted on the pressure plate 26 by the shoes 17 and 19 does not tend to pivot the handle 21 from the position shown in FIG. 2 towards the position shown in FIG. 3.

In a case where, during clamping of the prod parts 15 and 16 in their second positions, the strut 25 moves through the central position, pivoting of the handle 21 from the position shown in FIG. 2 towards the position shown in FIG. 3 will initially increase the stress in the strut 25 and lever 23 and will therefore be opposed by the force exerted on the pressure plate 26 by the shoes 17 and 19. Thus, the handle will normally be held releasably in the position shown in FIG. 2. In a case where the strut 25 moves to, but not beyond, the central position a releasable fastener may be provided for holding the handle 21 in the position shown in FIG. 2.

It will be noted that, in the position shown in FIG. 2, the handle 21 projects beyond the fore-end portion 10 in a direction away from the butt of the stock. The handle is conveniently formed as a stirrup into which a user can insert his foot to hold the stock during cocking of the bow. During clamping of the prod parts 15 and 16 in their second positions, the handle 21 is used as a lever. When used for this purpose and when used to hold the stock during cocking, a moderately long handle is more convenient than is a short handle. It will be understood that a relatively short handle is shown in the drawings for convenience of illustration.

Figure 4:
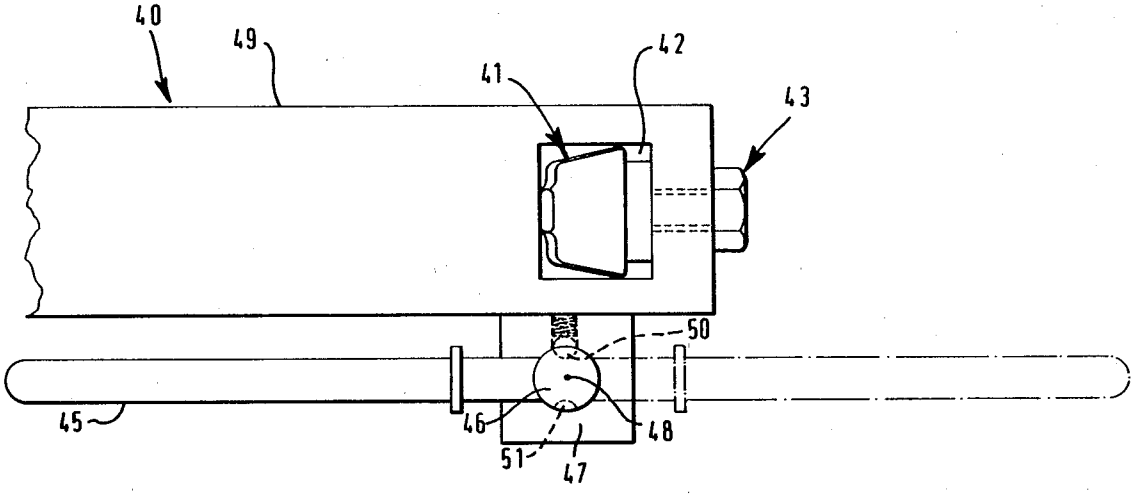
FIG. 4 illustrates a second example of crossbow.

The crossbow illustrated in FIG. 4 comprises a stirrup and clamping means for a prod but the stirrup does not form a part of the clamping means.

The cross bow illustrated in FIG. 4 comprises a stock 40, only a fore-end portion of which is illustrated, and which may be of known form and provided with a known trigger mechanism (also not shown). A one-piece bow prod 41 extends through an aperture 42 in the fore-end portion in a known manner. For clamping the prod to the fore-end portion, there is provided a screw and nut mechanism 43 which is accessible at the fore-end of the stock and which also may be arranged in a known manner.

The stirrup 45 is formed of a bent length of rod, opposite end portions of which are received in openings formed in a boss 46. The boss is mounted in a carrier 47 for pivoting relative thereto about a stirrup axis 48 which extends transversely of the stock 40 and lies at the underside thereof, remote from the guide surface 49 of the stock. The carrier 47 is secured by screws to the underside of the stock at a position near to the prod 41.

The stirrup 45 can pivot relative the stock 40 about the axis 48 between a first position illustrated by a full line in FIG. 4 and a second position indicated by a broken line in that figure. It will be seen that, when the stirrup is in its first position, a part of the stirrup remote from the axis 48 engages or is close to the stock 40 so that the stock prevents pivoting of the stirrup from its second position beyond its first position. For limiting pivoting of the stirrup from its first position beyond its second position, an abutment (not shown) may be provided on the carrier 47. It will be noted that the permitted range of movement of the stirrup relative to the stock is such that the stirrup cannot occupy a position in which any part of the stirrup is above the level of the guide surface 49, when the later is horizontal. Thus, the stirrup does not obstruct the path of a bolt fired from the crossbow.

Means is provided for yieldably opposing pivoting of the stirrup 45 from either of its first and second positions to which it has been set. This means comprises a spring-loaded ball 50 in the carrier 47 and a plurality of recesses 51 in the boss 46, into any selected one of which recesses the ball 50 can enter to inhibit pivoting of the carrier. Only two of these recesses are illustrated in FIG. 4, but it will be appreciated that a larger number of recesses would normally be provided and, to enable a larger number of alternative positions for the stirrup to be defined, there may be provided more than one spring-loaded ball, each with a corresponding row of recesses in the boss 46.

During firing of the bow, the stirrup 45 can be used as a finger grip, if set in its first position. When the stirrup is set in its second position, the user can insert a foot into the stirrup to hold the stirrup firmly on the ground during cocking of the bow.

It will be noted that the stirrup 45, boss 46 and carrier 47 can readily be attached to a crossbow subsequent to manufacture of that crossbow. Since the carrier 47 is mounted on the underside of the stock 40, pivoting of the stirrup 45 can readily be limited to a range such th at the stirrup does not intrude on the space immediately in front of the fore-end of the stock. There may be mounted in this space a reel of line without mutual interference between the reel and the stirrup occurring when the stirrup is in its second position. When the stirrup is in this position, it can be rested on the ground without the reel of line engaging the ground.

I claim:

1. A crossbow stock having a guide surface along which a bolt slides when fired from the bow and a stirrup mounted on the fore-end portion of the stock for pivoting relative thereto about a stirrup axis between a first position in which the stirrup extends from the stirrup pivot axis in a direction longitudinally of the stock beyond the fore-end of the stock and a second position in which a part of the stirrup remote from the stirrup axis lies adjacent to the stock, there being provided means for restricting the range of pivoting movement of the stirrup relative to the stock to prevent the stirrup occupying a position above the level of the guide surface of the stock when the stock is in the normal position of use with the guide surface facing upwardly and defining a horizontal path for a bolt.

2. A crossbow stock comprising a releasable clamping mechanism for clamping a bow prod in its position of use to the fore-end portion of the stock, a guide surface on the stock and along which a bolt slides when fired from the bow, a stirrup mounted on the fore-end portion of the stock for pivoting relative thereto about a stirrup axis between a first position in which the stirrup extends from the stirrup axis in a direction longitudinally of the stock beyond the fore-end of the stock and a second position in which a part of the stirrup remote from the stirrup axis lies adjacent to the stock and means for restricting the range of pivoting movement of the stirrup relative to the stock to prevent the stirrup occupying a position above the level of the guide surface of the stock when the stock is in the normal position of use with the guide surface facing upwardly and defining a horizontal path for a bolt, wherein the stirrup is a handle of the clamping mechanism.

* * * * *